US007940168B2

(12) United States Patent
Needham et al.

(10) Patent No.: US 7,940,168 B2
(45) Date of Patent: May 10, 2011

(54) SYSTEM, APPARATUS AND METHOD FOR AUTOMATED EMERGENCY ASSISTANCE WITH MANUAL CANCELLATION

(75) Inventors: Bradford Needham, North Plains, OR (US); Kofi B. Cobbinah, Houston, TX (US); Terrance Dishongh, Portland, OR (US)

(73) Assignee: Intel-GE Care Innovations LLC, Folsom, CA (US)

( * ) Notice: Subject to any disclaimer, the term of this patent is extended or adjusted under 35 U.S.C. 154(b) by 546 days.

(21) Appl. No.: 11/942,214

(22) Filed: Nov. 19, 2007

(65) Prior Publication Data

US 2009/0128320 A1 May 21, 2009

(51) Int. Cl.
*G08B 1/08* (2006.01)

(52) U.S. Cl. ..... 340/539.12; 340/539.11; 340/573.1

(58) Field of Classification Search ..... 340/539.1, 340/539.11, 539.13, 539.16, 539.17, 539.18, 340/539.22, 539.26, 573.1, 504, 539.15; 455/404.1, 435.1; 715/707; 600/513
See application file for complete search history.

(56) References Cited

U.S. PATENT DOCUMENTS

| | | | | |
|---|---|---|---|---|
| 6,262,730 | B1 * | 7/2001 | Horvitz et al. | 715/707 |
| 6,650,932 | B1 * | 11/2003 | Menzie et al. | 600/513 |
| 7,212,111 | B2 * | 5/2007 | Tupler et al. | 340/539.18 |
| 7,558,623 | B2 * | 7/2009 | Fischell et al. | 600/517 |
| 7,689,437 | B1 * | 3/2010 | Teller et al. | 705/2 |
| 2007/0152811 | A1 * | 7/2007 | Anderson | 340/539.11 |
| 2008/0001735 | A1 * | 1/2008 | Tran | 340/539.22 |

OTHER PUBLICATIONS

C.N. Scanaill et al., "A Review of Approaches to Mobility Telemonitoring of the Elderly in Their Living Environment", Annals of Biomedical Engineering, vol. 34, No. 4, Apr. 2006.

* cited by examiner

*Primary Examiner* — Van T. Trieu
(74) *Attorney, Agent, or Firm* — Pillsbury Winthrop Shaw Pittman LLP

(57) ABSTRACT

A system, apparatus and method for automated emergency assistance with manual cancellation that is responsive to physiological, environmental and/or input sensors associated with an individual. In embodiments, the invention enables a sensor system or device to be biased toward what would be false alarms, which may be avoided by the individual informing the device that he or she does not need assistance. Other embodiments are described and claimed.

13 Claims, 3 Drawing Sheets

SYSTEM, APPARATUS AND METHOD FOR AUTOMATED EMERGENCY ASSISTANCE WITH MANUAL CANCELLATION

BACKGROUND

Independence for many elderly or handicapped individuals is important. One aspect of independence is the ability to live alone (or spend time alone in one's home), if desired. These exist different types of devices that help facilitate the desire to live alone. Such devices are meant to assist the elderly or handicapped in emergency situations.

One such device is a call button. A typical call button device is a wearable device that the individual is supposed to press when they are having difficulty and need emergency assistance. Interviews with assisted living response staff and with manufacturers have revealed that elders in difficulty rarely press the call button. One reason for not using the call button may be attributed to a fear of being moved to assisted care because of their difficulty. Also, some difficulties, such as fainting, prevent the use of the call button.

Another device or system meant to assist the elderly or handicapped in emergency situations was designed as a response to the problems of the call button device. In this type of device, a sensor detects a potentially dangerous situation, such as the individual falling, and automatically calls for emergency assistance. One issue with this type of device is false alarms, due to the difficulty for the device to distinguish all emergency situations (such as falling) from all similar non-emergency situations, such as the individual dropping into bed, or dropping the fall-sensor of the device onto a desktop.

DETAILED DESCRIPTION

Embodiments of the present invention provide for automated emergency assistance with manual cancellation that is responsive to physiological, environmental and/or input sensors associated with an individual. In embodiments, the invention enables a sensor system or device to be biased toward what would be false alarms, which may be avoided by the individual informing the device that he or she does not need assistance. Other embodiments may be described and claimed.

Various embodiments may comprise one or more elements or components. An element may comprise any structure arranged to perform certain operations. Each element may be implemented as hardware, software, or any combination thereof, as desired for a given set of design parameters or performance constraints. Although an embodiment may be described with a limited number of elements in a certain topology by way of example, the embodiment may include more or less elements in alternate topologies as desired for a given implementation. It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
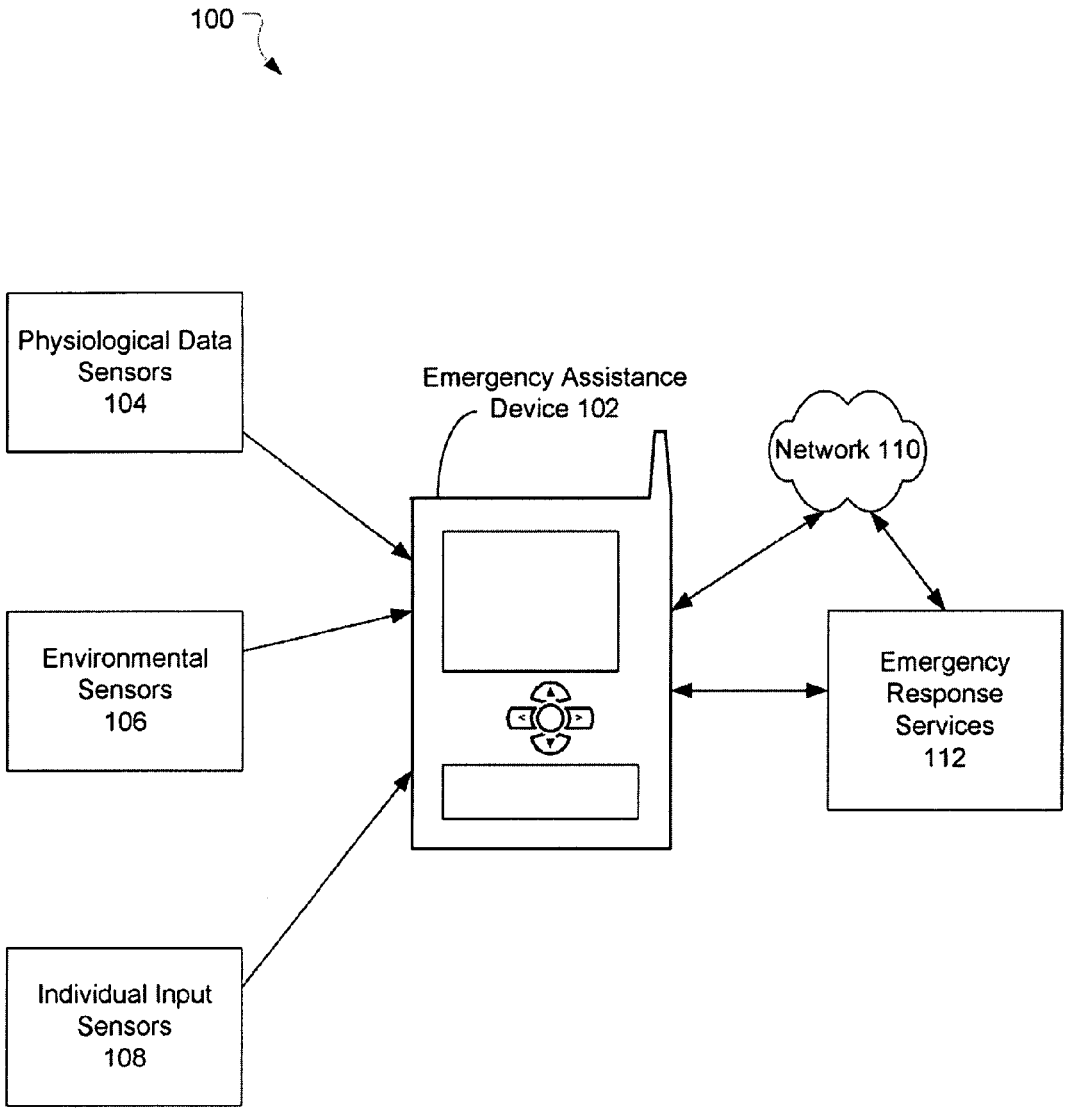
FIG. 1 illustrates one embodiment of a system for automated emergency assistance with manual cancellation.

FIG. 1 illustrates one embodiment of a system 100 for automated emergency assistance with manual cancellation. In one embodiment, system 100 comprises an emergency assistance device 102, one or more physiological data sensors 104, one or more environmental sensors 106, one or more individual input sensors 108, a network 110 and emergency response services 112.

At a high level and in an embodiment, real-time data is continuously collected for an individual via physiological data sensors 104, environmental sensors 106 and/or individual input sensors 108. The collected data are transmitted to emergency assistance device 102. Device 102 processes the data to determine whether the individual might be in need of emergency assistance. If a potential emergency is detected, then emergency assistance device 102 determines an appropriate test to administer to the individual. The test may be as simple as an alarm going off, for example. Embodiments of the invention provide for many types of possible tests including, but not limited to, an indication, such as a light or audible alarm beeping that requires input from the individual such as turning the alarm off; a test that requires input from the individual through, for example, a keyboard; a test that requires the individual to demonstrate that he or she is not in need of assistance (for example, walking into the next room which could be detected by the same sensors that detected a problem in the first place); and so forth. These example tests are provided for illustration purposes only and are not meant to limit the invention.

The individual is prompted to respond to the test and to implicitly or explicitly cancel the emergency situation if, in fact, no emergency exists. If the individual does not successfully respond to the test within a period of time, then device 102 requests emergency response services 112 for the individual. If the individual does successfully respond to the test, referred herein as a "manual cancellation", emergency response services 112 are not requested.

There are many well-known ways of performing requests for assistance. For example, dialing a phone and delivering a prerecorded message, sending an emergency message to a monitoring service, and so forth. Emergency response services 112 may be a professional emergency service such as an ambulance or it may be something less severe, like contacting a family member or caregiver.

In embodiments, emergency assistance device 102 may solicit emergency response services 112 via network 110 (e.g., the Internet, a local area network (LAN), a wide area network (WAN), etc.) or via a direct connection between device 102 and emergency response services 112. Device 102 may not only provide information about the individual regarding where the individual is located, etc., but also provide the collected data from physiological data sensors 104, environmental sensors 106 and individual input sensors 108 to better prepare the emergency response team to react to the emergency. All data/information may be communicated via a wireless connection, a wired connection, or some combination of both.

As discussed above, real-time data is continuously collected for an individual via physiological data sensors 104, environmental sensors 106 and/or individual input sensors 108. The collected data may be wirelessly transmitted to emergency assistance device 102 via, for example, Bluetooth technology, Zigbee technology or a proprietary system. The invention is not limited to these example wireless technologies. Alternatively, sensors 104, 106 and/or 108 may transmit data to device 102 via a wired connection, or some combination of wireless and wired connection technologies.

Sensors 104, 106 and/or 108 may also be adapted to store real-time data via integrated long term storage, such as flash memory for example, and then transmit the data to emergency assistance device 102 at a later time. The integrated long term storage helps to ensure that no collected data are lost if there is no connection currently available with device 102.

In an embodiment of the invention, physiological data sensors 104 may be small form factor devices that are worn by the individual and that are capable of monitoring and/or measuring physiological data or another type of data. Sensors 104, for example, may include an ECG device to measure a broad array of cardiovascular characteristics (e.g., heart rate variability, ECG amplitude, ST segment analysis, QT interval, etc.); a pulse oximeter unit to measure oxygenation level; a multiaxial accelerometer to measure activity level and orientation; a temperature sensor to measure temperature level; a unit to measure galvanic skin response; a pulse wave velocity monitor to monitor blood pressure; a minimally invasive or noninvasive glucometry monitor unit to measure blood sugar; and so forth. One or more of these sensors or units may be used either individually or in combination to collect physiological data for an individual. These examples are not meant to limit the invention. In fact, the invention contemplates the use of any means to monitor an individual.

In an embodiment of the invention, environmental sensors 106 may include any means of monitoring the individual's environment. For example, sensors 106 may include location sensors in the individual's home to detect where the individual is within the home and to help monitor the individual at home. Such location sensors may be placed in different rooms in the home and may interact with identification sensors that are worn and/or incorporated into emergency assistance device 102, and so forth. Location information may also be obtained via Global Positioning System (GPS) technology. For example, location sensors may help device 102 to determine that the individual is not moving about the house as he or she normally does, and thus potentially experiencing difficulty.

Environmental sensors 106 may also include door switches within the home that detect when doors are opened. Door switches may help device 102 to determine that the individual is leaving the house at a time of day not normal (e.g., in the middle of the night) and thus may be in need of assistance. A door switch may be, for example, a magnetic reed switch, or may be a sensor that detects that the door has moved. This may be of particular help in monitoring individuals experiencing dementia. Environmental sensors 106 are not limited to these examples.

In embodiments of the invention, individual input sensors 108 may include various ways in which an individual may provide data or feedback to emergency assistance device 102 via direct or indirect input into device 102. This may include, but is not necessarily limited to, health data such as the individual is experiencing unexplained headaches that day or an upset stomach, and so forth.

Other embodiments of the invention may use data (e.g., environmental data and medical data) to prompt a user to not perform certain activities. For example, a person who is highly susceptible to pneumonia may be prompted to not go outside on days when the weather is cold. Another example might involve a person who has very dilated eyes (known from past medical records) would be prompted to not drive a car. If it is determined that the person is disregarding the prompt to not perform certain activities, then embodiments of the invention may determine that an emergency situation has occurred and respond accordingly.

As described above, real-time data is continuously collected for an individual via physiological data sensors 104, environmental sensors 106 and/or individual input sensors 108. The collected data are transmitted to emergency assistance device 102. Device 102 processes the data to determine whether the individual might be in need of emergency assistance.

In one embodiment, emergency assistance device 102 may be any mobile device capable of performing the functionality of the invention described herein. Device 102 may be implemented as part of a wired communication system, a wireless communication system, or a combination of both. In one embodiment, for example, device 102 may be implemented as a mobile computing device having wireless capabilities. A mobile computing device may refer to any device having a processing system, and which can be easily moved from place to place.

Examples of embodiments of a mobile computing device that may be adapted to include the functionality of the present invention include a laptop computer, ultra-mobile computer (UMPC), portable computer, handheld computer, palmtop computer, personal digital assistant (PDA), cellular telephone, combination cellular telephone/PDA, smart phone, pager, one-way pager, two-way pager, messaging device, data communication device, and so forth.

Examples of such a mobile computing device also may include computers that are arranged to be worn by a person, such as a wrist computer, finger computer, ring computer, eyeglass computer, belt-clip computer, arm-band computer, shoe computers, clothing computers, and other wearable computers.

In various embodiments, system 100 may be implemented as a wireless system, a wired system, or a combination of both. When implemented as a wireless system, system 100 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 100 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Figure 2:
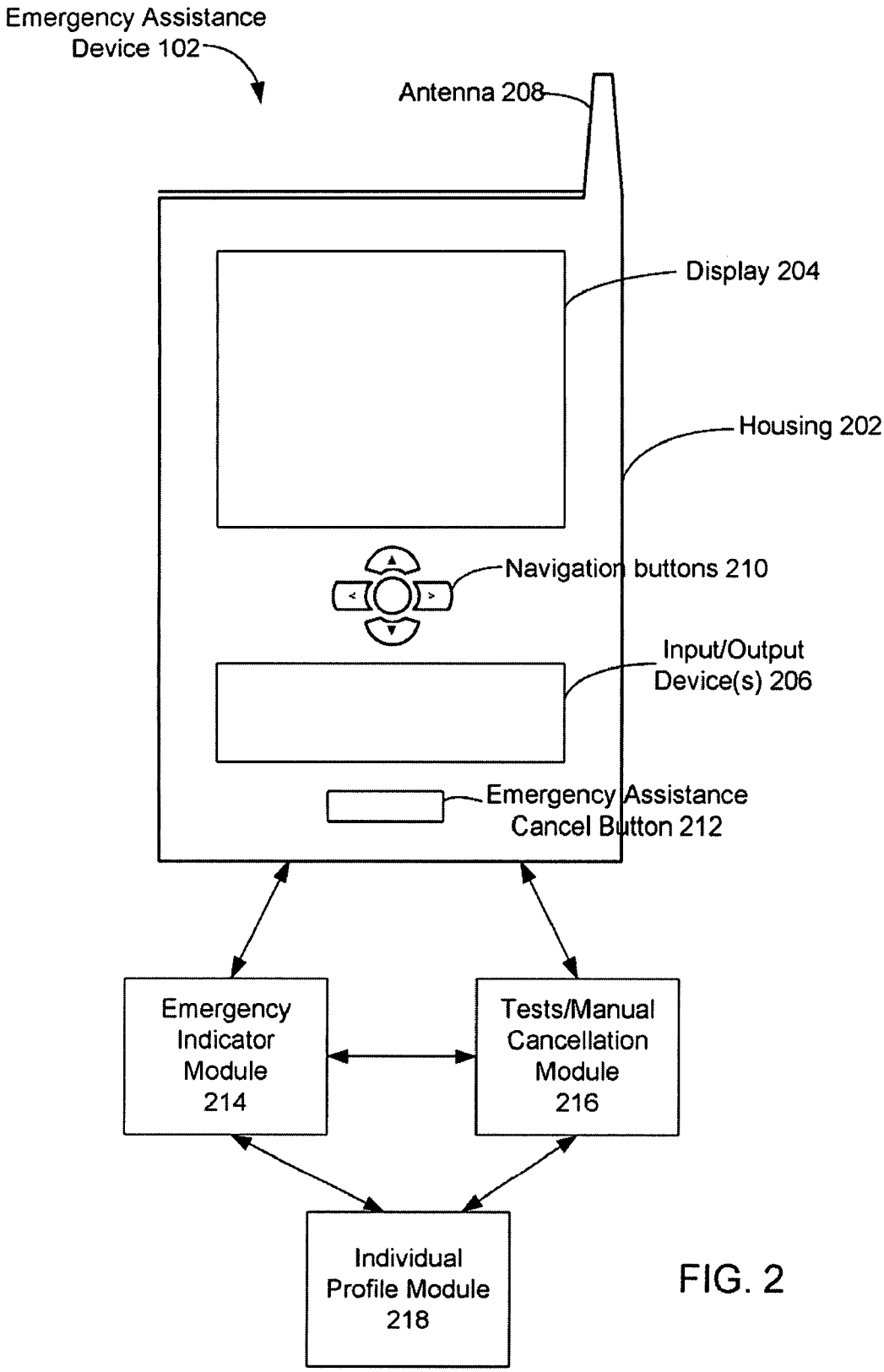
FIG. 2 illustrates one embodiment of an apparatus for automated emergency assistance with manual cancellation.

A more detailed description of an embodiment of emergency assistance device 102 is shown in FIG. 2. Referring to FIG. 2, device 102 may include a housing 202, a display 204, one or more input/output devices 206, an antenna 208, navigation buttons 210, an emergency assistance cancel button 212, an emergency indicator module 214, a tests/manual cancellation module 216 and an individual profile module 218.

Emergency indicator module 214, tests/manual cancellation module 216 and individual profile module 218 may be directly integrated into device 102 or may be coupled to device 102 via a connection (e.g., wireless, wired or some combination of both). Note that although the functionality of modules 214, 216 and 218 is described herein as being separated into three components, this is not meant to limit the invention. In fact, this functionality may be combined into one or two components, or separated into four or more components. Additionally, one or more of emergency indicator module 214, tests/manual cancellation module 216 and/or individual profile module 218 may be customized for an individual. Each of the components of FIG. 2 is described next in more detail.

Housing 202 may comprise any suitable housing, but typically involves a small form factor to enable emergency assistance device 102 to be easily transportable.

Display 204 may comprise any suitable display unit for displaying information appropriate for a mobile computing device. Display 204 is used by the invention to display tests to the individual for manual cancellation of emergency assistance, to assist with input into device 102, and so forth.

I/O device(s) 206 may comprise any suitable I/O device for entering information into and receiving information from emergency assistance device 102. Examples for I/O device(s) 206 may include touch screen interfaces, simple menus with icon selection, gestural manipulation of the device, a suitable alphanumeric keyboard, a numeric keypad, a touch pad, input keys, buttons, switches, rocker switches, a microphone, a speaker, voice recognition device and software, as well as all of the physiological sensing described above, and so forth. Information may be entered into device 102 by way of microphone. Such information may be digitized by a voice recognition device. The embodiments are not limited in this context.

Antenna 208 is used to facilitate wireless communication with emergency assistance device 102.

In one embodiment, navigation buttons 210 comprise an upward navigation button, a downward navigation button, a leftward navigation button, and a rightward navigation button. Navigation buttons 210 also may comprise a select button to execute a particular function on emergency assistance device 102.

As described above, emergency indicator module 214 processes the data sent from physiological data sensors 104, environmental sensors 106 and/or individual input sensors 108 to determine whether an individual is potentially in need of assistance. If so, tests/manual cancellation module 216 determines an appropriate test to administer to the individual and appropriate input from the individual to cancel the assistance. Here, in embodiments, modules 214 and 216 may reference individual profile module 218 to further customize the invention for a particular individual.

In embodiments, individual profile module 218 may store information specific to the individual. For example, module 218 may store specific health conditions, physical limitations, sleeping patterns, test and manual cancel preferences, and so forth.

For example, assume that individual profile module 218 stores data that indicates an individual's routine includes going to bed at 10:00 pm in his or her bedroom on the second floor of the house and getting up the following morning at 8:00 am. Assume further that via environmental sensors 106 (i.e., location sensors placed within the home) it is determined by emergency indicator module 214 that the individual has been in his or her basement from 9:00 pm until 1:00 am. Here, the individual may have gone into the basement and is now unconscious. Tests/manual cancellation module 216 may issue a test for the individual. The test may require the individual to press emergency assistance cancel button 212 on device 102 or on a peripheral input device, for example, if assistance is not necessary. If the individual does not press the cancel button within a fixed amount of time, then emergency assistance is automatically requested for the individual.

Another possible example may involve an individual known to have dementia (e.g., medical data stored in individual profile module 218). Assume that via environmental sensors 106 (i.e., a door switch on the front door) it is determined by emergency indicator module 214 that the front door was opened and closed at a time during the night when the individual is usually sleeping. Here, the individual may have wandered outside of his or her home. Tests/manual cancellation module 216 may issue a test for the individual. Such a test may involve an audio message played on a speaker incorporated into emergency assistance device 102 (or another component in the home) that asks the individual whether he or she is okay. Speaker-independent voice recognition functionality incorporated into device 102 may be used to detect the word "yes" from the individual. If device 102 does not detect the word "yes" within a determined period of time, then emergency assistance is automatically requested for the individual.

The above examples are provided for illustration purposes only and are not meant to limit the invention. The number and variety of test and manual cancellation procedures contemplated by embodiments of the invention are limitless. For example, another test procedure may involve flashing alarm lights and/or alarm noises. Here, possible manual cancellation procedures may involve the individual pressing a cancel button on a wall mounted device or entering a cancel code into the device. A test for whether the individual has had a stroke may involve requiring the individual to enter different codes or numbers into a device as a cognitive test. A test for slurred speech may also indicate a need for emergency assistance.

Operations for the above embodiments may be further described with reference to the following figures and accompanying examples. Some of the figures may include a logic flow. Although such figures presented herein may include a particular logic flow, it can be appreciated that the logic flow merely provides an example of how the general functionality as described herein can be implemented. Further, the given logic flow does not necessarily have to be executed in the order presented unless otherwise indicated. In addition, the given logic flow may be implemented by a hardware element, a software element executed by a processor, or any combination thereof.

Figure 3:
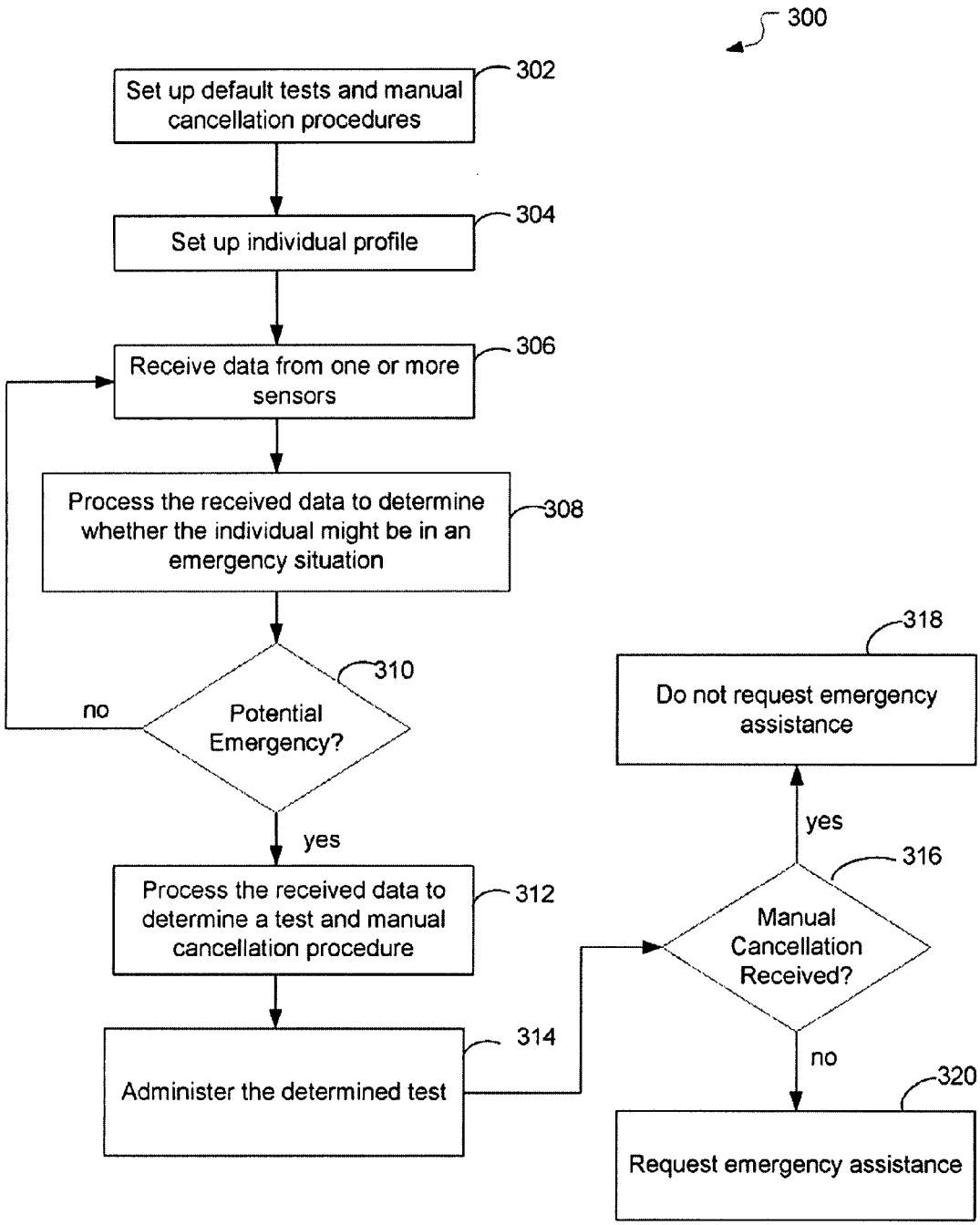
FIG. 3 illustrates one embodiment of a logic flow for automated emergency assistance with manual cancellation.

FIG. 3 illustrates one embodiment of a logic flow 300. The logic flow 300 may be representative of the operations executed by one or more embodiments described herein, for example, the operations executed by system 100.

Referring to FIG. 3, initial default tests and manual cancellation procedures are set up in emergency assistance device 102 (block 302). An individual's profile may be populated with information specific to the individual, as discussed above (block 304).

Data is received by emergency assistance device 102 (block 306). In an embodiment, the data received represents data collected about the individual via physiological data sensors 104, environmental sensors 106 and/or individual input sensors 108, as described above.

The received data is processed by emergency assistance device 102 to determine whether the individual might be in need of emergency assistance (block 308). If it is determined that the individual is not in need of emergency assistance (block 310), then control goes back to block 306, where the individual is continuously monitored.

If it is determined that the individual might be in need of assistance (block 310), then emergency assistance device 102 determines a test to administer to the individual and the manual cancellation procedure (block 312). Device 102 administers the test (block 314). If after a predetermined amount of time the manual cancellation was not received from the individual (block 316), then device 102 requests emergency assistance (block 320). If the manual cancellation was received from the individual, then no emergency assistance is requested (block 318).

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" alone with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable or computer-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A method comprising:

receiving data relating to the physical state of an individual;

determining, via the received data and stored personal data specific to the individual, that the individual might need assistance;

determining a test including a manual cancellation procedure utilizing the received data and the stored personal data, wherein the test is customized and appropriate for the individual's current situation;

administering the test to the individual to determine whether to request assistance; and if a manual cancellation is not received from the individual in response to the test within a period of time, requesting assistance for the individual, wherein the received data is collected from the individual via an input device that comprises physiological monitoring of the individual, and wherein the test requires the individual to demonstrate that the individual is not in need of assistance.

2. The method of claim 1, wherein the received data further comprises one or more of environmental data for the individual and input provided by the individual.

3. The method of claim 2, wherein the environmental data is collected via one or more of location sensors and door switches.

4. The method of claim 2, further including prompting the individual not to perform an activity based on the received data.

5. The method of claim 1, wherein the physiological monitoring includes monitoring at least one of an oxygenation level, a galvanic skin response, a blood pressure and a blood sugar level of the individual.

6. The method of claim 1, wherein administering the test includes:

receiving additional data relating to movement of the individual; and determining whether the manual cancellation has been received based on the additional data.

7. An apparatus comprising:

a processor, and at least one input device, wherein the apparatus is capable of receiving data relating to the physical state of an individual from the at least one input device, wherein the apparatus is capable of determining, via the received data and stored personal data specific to the individual, that the individual might need assistance, wherein the apparatus is capable of determining a test including a manual cancellation procedure utilizing the received data and the stored personal data, wherein the test is customized and appropriate for the individual's situation, wherein the apparatus is capable of administering the test to the individual to determine whether to request assistance, and, if a manual cancellation is not received from the individual in response to the test within a period of time, wherein the apparatus is capable of requesting assistance for the individual, wherein the received data is to be collected from the individual via the at least one input device that comprises physiological monitoring of the individual, and wherein the test is to require the individual to demonstrate that the individual is not in need of assistance.

8. The apparatus of claim 7, wherein the received data further comprises one or more of environmental data for the individual and input provided by the individual.

9. The apparatus of claim 8, wherein the environmental data is collected via one or more of location sensors and door switches.

10. The apparatus of claim 7, wherein the at least one input device communicates wirelessly with the apparatus.

11. A machine-readable medium containing instructions which, when executed by a processing system, cause the processing system to perform instructions for:

receiving data relating to the physical state of an individual;

determining, via the received data and stored personal data specific to the individual, that the individual might need assistance;

determining a test including a manual cancellation procedure utilizing the received data and the stored personal data, wherein the test is customized and appropriate for the individual's situation, administering the test to the individual to determine whether to request assistance; and if a manual cancellation is not received from the individual in response to the test within a period of time, requesting assistance for the individual, wherein the received data is to be collected from the individual via an input device that comprises physiological monitoring of the individual, and wherein the test is to require the individual to demonstrate that the individual is not in need of assistance.

12. The machine-readable medium of claim 11, wherein the received data further comprises one or more of environmental data for the individual and input provided by the individual.

13. The machine-readable medium of claim 12, wherein the environmental data is collected via one or more of location sensors and door switches.

* * * * *